United States Patent [19]

Proctor

[11] Patent Number: 4,695,031

[45] Date of Patent: Sep. 22, 1987

[54] GANG FORM

[76] Inventor: Edward A. Proctor, 3417 Clarendon Rd., Cleveland Heights, Ohio 44118

[21] Appl. No.: 797,843

[22] Filed: Nov. 14, 1985

Related U.S. Application Data

[63] Continuation-in-part of Ser. No. 575,288, Jan. 30, 1984, abandoned.

[51] Int. Cl.[4] ..... B28B 7/22

[52] U.S. Cl. ..... 249/91; 249/93; 249/99; 249/112; 249/120; 249/123; 249/126; 249/145; 249/155; 249/176; 249/50; 264/297.9

[58] Field of Search ..... 249/20, 21, 50, 91, 249/93, 94, 96, 116, 119, 120, 123, 126, 145, 146, 155, 158, 176, 177, 99, 112; 264/297.9, 297.4, 34; 425/63, 111

[56] References Cited

U.S. PATENT DOCUMENTS

| | | | |
|---|---|---|---|
| 1,460,197 | 6/1923 | George | 249/20 |
| 1,580,518 | 4/1926 | Martine | 249/50 |
| 1,655,725 | 1/1928 | Crozier | 425/63 |
| 1,744,702 | 1/1930 | Leeder | 264/297.9 |
| 2,458,155 | 1/1949 | Fraser | 249/126 |
| 2,499,532 | 3/1950 | Shearer | 249/126 |
| 2,516,318 | 7/1950 | Hawes | 425/63 |
| 2,611,944 | 9/1952 | Bailey | 264/34 |
| 2,723,437 | 11/1955 | Ghormley et al. | 249/20 |
| 3,618,181 | 11/1971 | Veale | 249/20 |
| 4,141,532 | 2/1979 | Wall | 249/126 |
| 4,290,991 | 9/1981 | Thim | 264/297.9 |

FOREIGN PATENT DOCUMENTS

| | | | |
|---|---|---|---|
| 483016 | 10/1929 | Fed. Rep. of Germany | 249/50 |
| 527072 | 5/1931 | Fed. Rep. of Germany | 249/126 |
| 818848 | 10/1951 | Fed. Rep. of Germany | 249/21 |
| 864375 | 1/1953 | Fed. Rep. of Germany | 249/21 |

*Primary Examiner*—Willard E. Hoag
*Assistant Examiner*—James C. Housel

[57] ABSTRACT

A gang form in which a single or a plurality of precast concrete beams will be molded at one time, the gang form comprising a first and two second vertical walls, the first wall being a straight wall, the two second walls spaced apart one from another extend transversely away from the first wall while having an end abutting the first wall, a tier or tiers of precast concrete beams being molded by placing fluid concrete into a mold compartment comprising the top surface of either a starter slab or a previously precast beam, a longitudinal segmental strip of a vertical surface of the first wall or the vertical surface of a previously constructed tier and an individual mold side member, which side member is restrained by restraint means placed exterior of said mold compartment, the restraint means allowing the individual mold side member to be adjusted vertically while also being adjusted horizontally at various distances apart from a face of the first wall, the precast concrete beams while molded in their mold compartment are in an unnatural first arrangement with the natural sides of the beams being superimposed one upon another, in the first arrangement the natural top and bottom of the beams are molded against one or the other of a vertical face of the first wall or against the individual mold side member, the vertical faces of the first wall and the interior face of the individual mold side member being so constructed to imprint either a plain smooth surface or a special corrugated surface to the natural top and bottom surfaces of the precast concrete beams when being molded in their unnatural first arrangement.

12 Claims, 32 Drawing Figures

FIG. 9
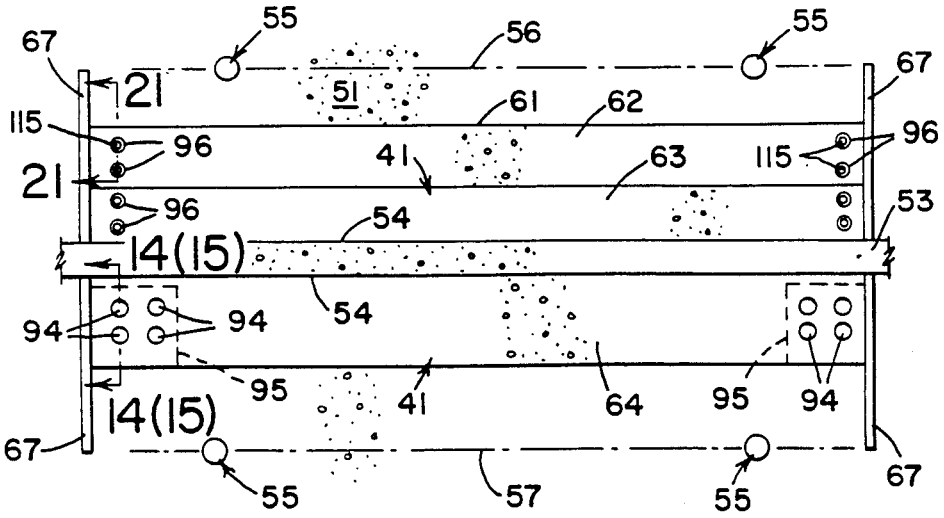
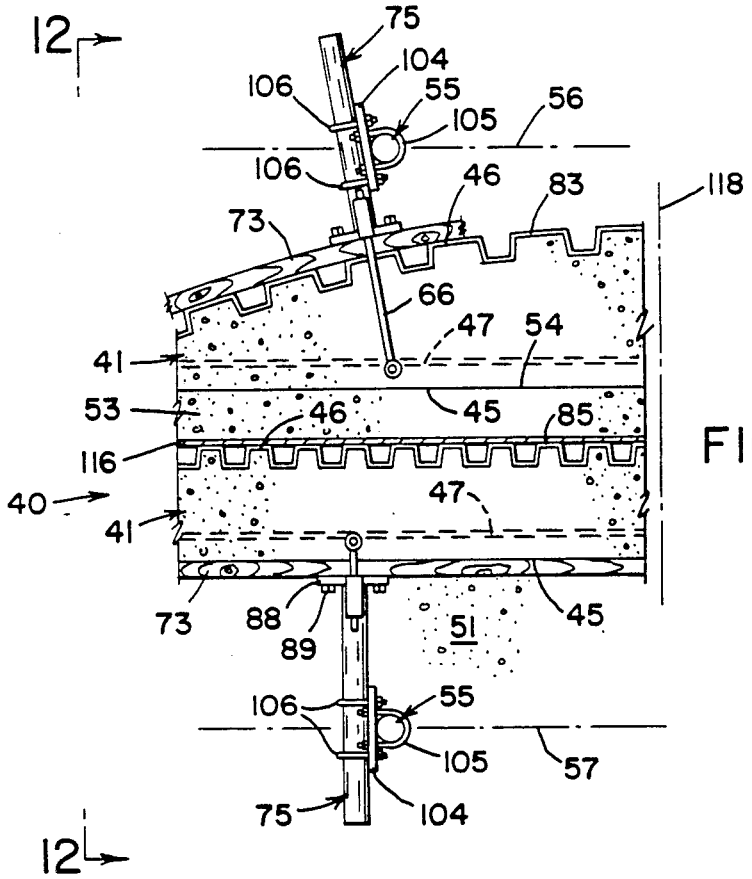
FIG. 10

FIG. 13
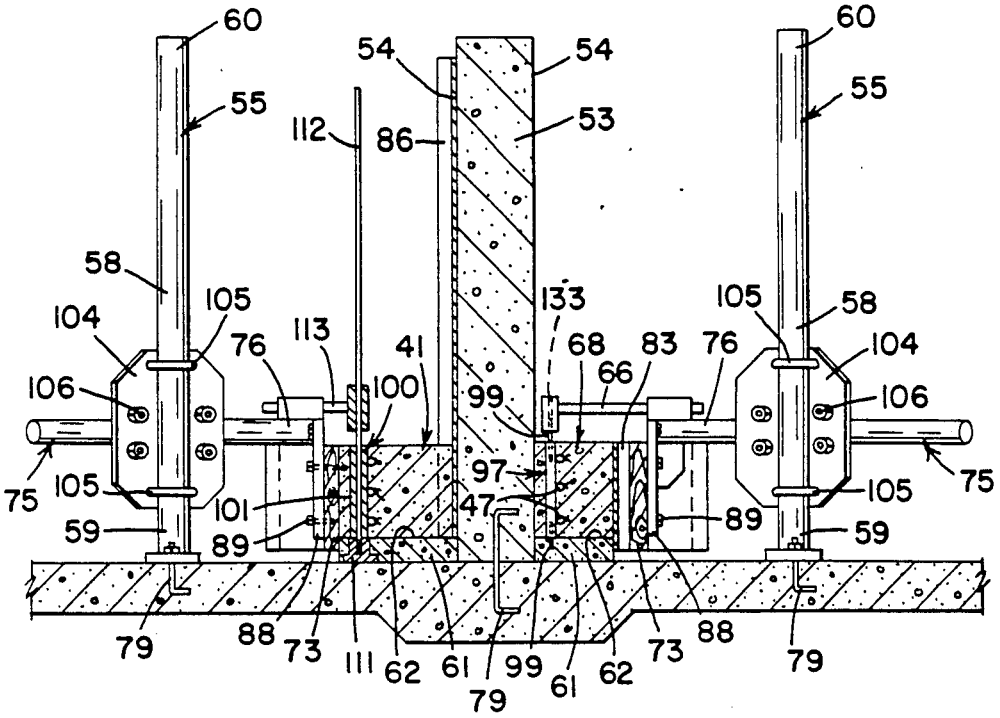
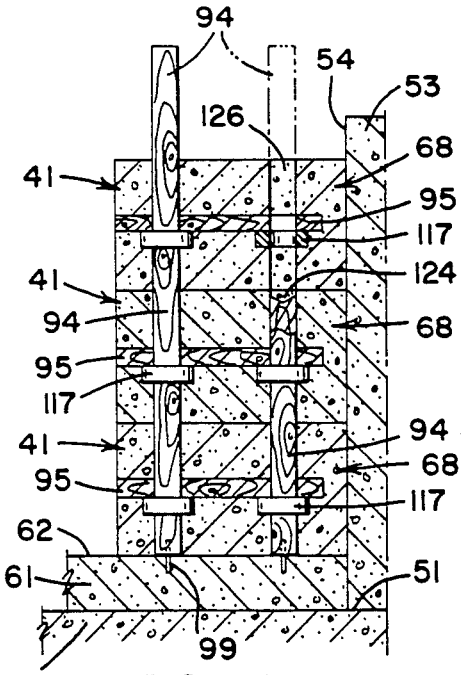
FIG. 14
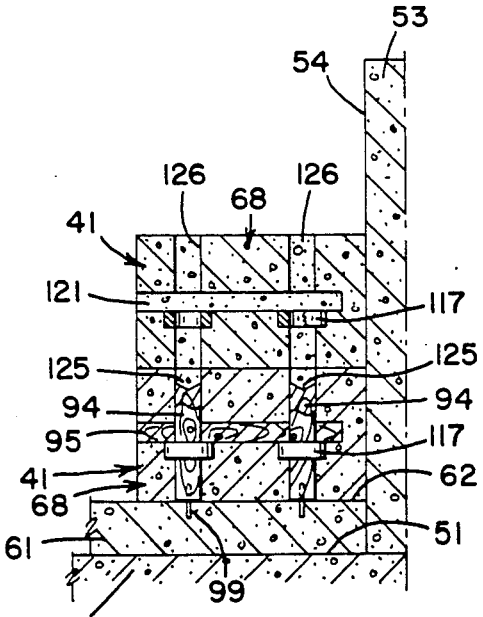
FIG. 15

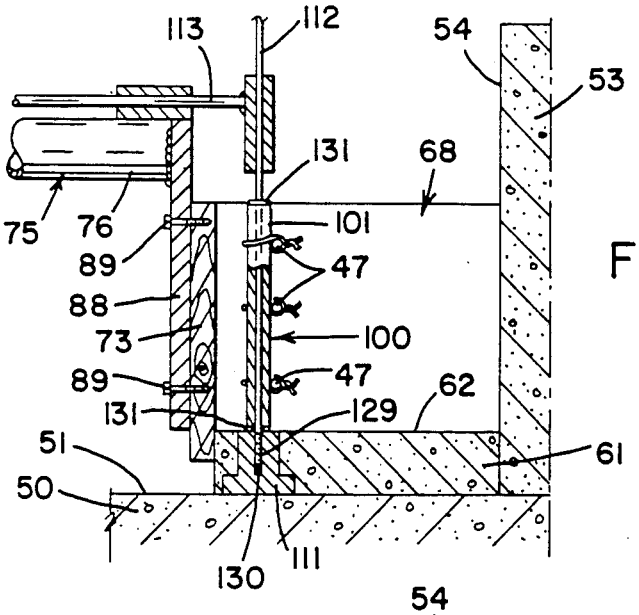
FIG. 24
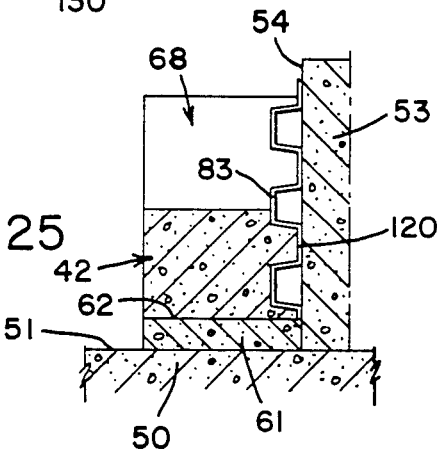
FIG. 25
FIG. 26
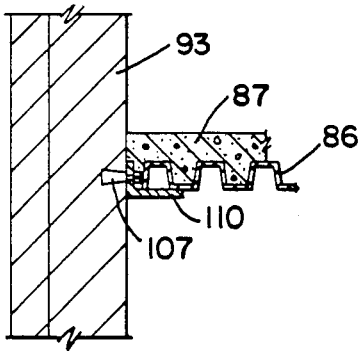
FIG. 27
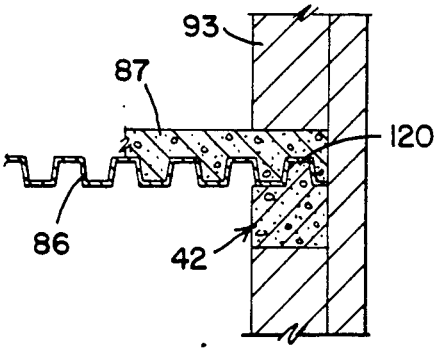

GANG FORM

This application is a continuation-in-part of applicant's parent application, Ser. No. 575,288, filed Jan. 30, 1984, and now abandoned.

BRIEF SUMMARY OF THE INVENTION

It is a primary object of my invention to provide a new and novel improved gang form, use of which will facilitate inexpensive forming of precast longitudinal concrete members; generally those members which will, when functioning in their natural arrangement in a structure, act as beams, header beams or girts. Such beams and girts will have corrugated sheets attached whether the sheets be a corrugated form deck, a composite floor or roof deck, a metal roof deck, or any of the many siding sheathing sheets which have some corrugated or similar configuration, and in many instances are of plastic material composition. The beams, and girts will be constructed with built-in juncture means used to make the attachment of the corrugated sheets.

Both steel and concrete joists whether floor or roof joists and whether horizontal, sloping or curved, have surfaces to which corrugated sheets need to be attached thereto. Such surfaces, even when horizontal and flat, have never been successfully attached to corrugated sheets by present day procedures.

Present day attachment of corrugated sheets to supporting beams is either by welding or some type of mechanical fasteners.

Welding in the field of corrugated sheets is limited to only steel members and cannot be applied to concrete beams unless the beams are modified.

Field welding, even to steel members, whether the members be steel joist, beams or open web bar joists, encounters a first difficulty of the member having been coated with several layers of paint.

Field welding, even to steel members, encounters a second difficulty of the corrugated sheets having been coated on both sides with several coats of paint or galvanizing. The coats of paint on corrugated sheets are thicker than the thickness of the stock metal of the sheet itself. This condition exists because the sheets, being very thin, must be carefully protected by paint to insure their support integrity. Where the ends of corrugated sheets are both overlapped and nested, an extremely difficult welding situation is present because of the multitude of painted surfaces overlapping one another at one location.

When field welding corrugated sheets to steel members, the welder must first burn away the thick paint or galvanizing to expose the surface of metal to be welded. This requires the welding rod to be coated with a scavenger coating such as aluminum. There is a practical limit of the extent to which the welding rod can be coated with a scavenger coating.

The preburning of paint from members is in an obnoxious operation because of the smoke and fumes produced thereby, while also being unproductive.

Additionally, when welding at the bottom of narrow ribs of narrow rib metal roof deck, the welding rod becomes too close to the sides of the rib, causing the rod to short out transversely against the sides of the ribs.

When a Structural Engineer attempts to achieve good welding of the corrugated sheets to the steel members, he will probably specify that the welding be done through welding washers. When the Engineer later inspects the installed roof deck, he will find that no welding washers have been used and the welders have thrown the washers down upon the ground below. Upon bringing the welders to task, he will be informed that the use of welding washers only makes a very difficult task into an impossible task.

When walking across a newly installed roof deck, or event an installed composite floor form, the walker will hear welds both in front of him and behind him popping loose. This situation is very pronounced in installations of metal roof deck on open web bar joists, because both the roof deck and supporting open web roof joists are very flexible and easily deflected under even slight loads. This is one reason why metal roof decks would function better if they were installed in more rigid concrete members which are less easily deflected under load.

A corrugated composite floor forms are generally made from heavier stock than metal roof decks and generally have deeper corrugations making them less flexible. The composite floor forms, after being installed, become a part of a superimposed concrete slab which makes the form much less susceptible to deflection. With less deflection in the corrugated sheets, less failure of welds would occur. When failure of welds does occur, there exists no connection between the corrugated sheets and their supporting steel member.

Another difficulty encountered with field welding is weather conditions. Excessive wind makes field welding difficult. Welding must also be done on dry surfaces.

If a Structural Engineer would consult an instructor in a welding school, he would learn that welding students have little difficulty in welding normal thickness of metal, but generally will not be capable of welding thin metals such as roof decks or other such corrugated forms. Generally a welder with an extensive experience and skill such as the instructor would only be able to weld thin gaged metals. Contractors will have to send back many welders to their union halls before and if they can find a welder capable of welding thin gaged metal. If this is not the case, the Structural Engineer would not be meeting his responsibilities in inspecting the field welds.

Mechanical fasteners have never become widely used to attach corrugated sheets to steel or concrete beams. Use of such fasteners are expensive and time-consuming compared to ineffective field welding, although use of mechanical fasteners would be more reliable as a general rule. I have never known of a mechanical fastener suitable for attaching corrugated sheets to concrete members.

By using my improved gang form, I can contruct precast concrete members having one or two opposing corrugated surfaces on the member. These corrugated surfaces known as built-in juncture means will be suitable for nesting the corrugated sheets of metal roof deck or composite floor form into said preformed surface to achieve a tighter than glove tight fit between the member and the corrugated sheet. The nesting of the corrugated sheets into the preformed corrugated surface of the concrete member produces what is commonly known as a pressed tight fit, such a fit is similar to the fit created when tapered pins are driven into tapered holes. Such a pressed tight fit is quickly and easily accomplished by driving the corrugated sheets down into the mating preformed corrugations of a supporting member. Insertion of the concave valleys of the sheets into the mating preformed valleys of the beam produces a wedge pinching action, while the capping of convex ridges of the sheets over their mating preformed ridges produces a stretching action.

Should an absolute rigid unyielding connection between the corrugated sheet and the mating precast concrete member be desired and required, a quantity of adhesive can be applied to the contacting surfaces of the corrugated sheet. This is also a quick and inexpensive field operation. Such a field operation would not be subjected to those adverse conditions which welding is subjected to during its performance.

Only by molding concrete members such as beams and girts in my new tipped-on-a-side while being molded in a first arrangement can such members be so constructed that a tighter than glove tight fit can be achieved between corrugated sheets and their precast support members. Such tight fits will be inexpensive, reliably secure, and can be made absolutely rigid by an application of adhesive.

When a roof deck is not securely attached to its supporting members, it will still function in supporting the usual dead loads such as snow. But when a roof deck is not securely attached to its supporting beams, it is readily blown away because the vacuum created by the wind passing over the roof creates upward forces greater than the combined weight of the roof deck and its covering.

This is proven by every hurricane blowing the roofs off of most buildings in its path.

Another object of my invention is to provide precast concrete beams and girts with means for easy and reliable attachment to columns whether the columns be steel or concrete. Since precast concrete beams are generally produced as a plurality of similar members of similar length with similar attachment requirements at their ends, such members are required to be constructed as identical members with identical dimensions and hole patterns. When constructing precast concrete beams in a tipped on a side while being molded in a first arrangement, it is very easy to duplicate dimensions and attachment hole patterns in all of the members making up a tier of similar members, as this application will hereafter point out.

During molding a tier of precast concrete beams in my improved gang form, I secure a plurality of vertical guide rods in a desired pattern at the end of each beam. As individual precast members of the tier are poured, pipe sleeves in the desired pattern are dropped over the vertical guide rods and are thereafter embedded in the precast beam. With this construction procedure, the dimensions and pattern arrangement of the pipe sleeves in each beam within a tier of beams is identical one to another.

During molding a tier of precast concrete beams in my improved gang form, I secure a small plurality of medium vertical guides in a desired pattern at the approximate quarter points of all the beams in the tier. Prior to pouring each beam in the tier, medium diameter pipe sleeves in this desired pattern are dropped over the vertical medium sized guides, thereafter being embedded in the precast beam. Such precast concrete beams, while in use in a second arrangement, they have a small plurality of transverse medium pipe sleeves to accommodate transverse utility pipes, ducts, conduits and cables.

Even knock out plates can be provided at the end portions of my precast concrete beams. Such knock out plates have bolt sized holes aligned by a pattern of vertical expendible guides, thereby providing each knock out plate with a similar location in each beam within a tier of superimposed precast beams. The expendible guide is of such a nature that a rotating twist drill will drill or otherwise demolish the guide as and when needed. This uniform location and dimension provided the knock out plates provide for easy and reliable attachment to gusset plates to which the precast concrete beams are ultimately to be attached. Because upon being knocked away, the knock out plate leaves a broad flat recess into which can be inserted a gusset plate, even though it is attached to a column.

It has been known for some time that variable sectioned beams such as single and double sloping bottom surfaced beams and also beams having a bottom curvilinear surface have advantages due to their variable depths such as the transverse passage of utility ducts and pipes at the shallow end portions of such beams. When it is desired to place medium diameter transverse holes in beams, it is easier to place such holes at the deeper portions of the beam.

Roofs of buildings as a practical consideration are generally single sloping, double reverse sloping or curvilinear. The required sloping surfaces of roofs has always induced extra expense into their construction. With use of my improved gang form, it is both easy and economical to construct beams with any desired sloping top surface. It is further easy to produce the identical slope in each of a plurality of similar beams in a single tier of precast beams. Such precast concrete beams with sloping surfaces, whether a bottom surface or a top surface, have the advantages mentioned above as well as the dual advantage of having a corrugated top surface into which corrugated sheets can be rigidly attached with a tighter than glove tight fit between the support surface and the supported sheet surface.

In hurricanes, such as Gloria, the wind forces first strip the sheathing off of the roof; then, with the absence of any support from the roof sheathing, the wind forces topple over the supporting walls.

With a paste-board box attached to a table top when the box has a cover glued to its top, the experimenter finds it is difficult to collapse the sides of the box by pushing against same. With a similar paste-board box attached to a table top when the box has no attached cover, it is very easy to collapse the box by pushing against same.

A different although similar phenomenon of loosely attached floors and roofs to buildings is also a factor in producing the disastrous effects of earthquake on buildings as well as hurricanes.

The attachments of floors and roofs to their supports, whether to beams or walls, act as joints. Loosely or nonconnected floors and roofs can be considered as flexible joints while secure connections of these members can be considered as rigid joints. I am sure a building with loose joints would be more vulnerable to collapse during an earthquake than a similar building having rigid joints. When a contractor constructs a building, he is not concerned with the rigidity of the connections of his floors and roofs to their supports because he feels certain his building will remain standing long enough for him to receive his paid contract price. The instances wherein an intervening hurricane or earthquake interfers with this usual construction practice is very seldom and therefore will not alter the usual established construction practice, unless education is introduced to establish a more intelligent construction practice.

By use of my improved gang form, I can construct precast concrete beams which can be rigidly attached to building walls, thus reducing the vulnerability of buildings to earthquakes and hurricanes. Not only will the beams be attached to the walls, but also all floor and roof slab will be attached to the walls.

Further study of this invention will show that its use can reduce the vulnerability of buildings to explosions, atomic blasts, mud slides, floods and even fires. Even though such is very evident, it will not be explained in detail because what has been explained relative to hurricanes and earthquakes presents applicable similar principles.

BRIEF DESCRIPTION OF THE DRAWINGS

FIGS. 2 and 3 show longitudinal segments 72 of the vertical surface 54 of wall 53. FIGS. 2 and 3 show posts 55 having a body portion 58 between bottom ends 59 and top ends 60.

FIG. 4 shows narrow rib metal roof deck 82 and wide rib metal roof deck 83 nested into the valleys 80 and capping the ridges 81 of the beam 41.

FIG. 5 shows small sectioned composite floor form 85 and large sectioned composite floor form 86 nested into the valleys 80 and capping over the ridges 81. A concrete floor slab 87 is ultimately poured over the composite floor forms 85 and 86 which remain permanently in place to supply positive slab reinforcement between supporting beams.

FIGS. 7 and 8 show that the support arm 75 has attached a second plate 88 with holes engaging lag screws 89, making an attachment to individual side member 73. FIGS. 7 and 8 show a mold compartment 68 above a starter slab 61. FIG. 8 shows tiers 63 and 64 of precast beams 41 resting on starter slabs 61 while adjacent to wall 53.

FIG. 9 is a cross-sectional view taken along line 9—9 as shown in FIGS. 2 and 3 and looking in the direction of the attached arrows while showing starter slabs 61.

FIG. 10 is a half-plan view of gang form 40 showing above wall 53 a roof beam 41 suitable for a dome type roof. FIG. 10 also shows below wall 53 a precast beam 41 with a horizontal top preformed special corrugated surface 46 suitable for nesting small sectioned composite floor form 85.

FIG. 11 below wall 53 shows a precast beam 41 having a level top special surface 46 suitable for nesting large sectioned composite floor form 86 while having a sloping bottom plain surface 45.

FIGS. 12 and 13 are cross-sectional views taken respectively along 12—12 on FIG. 10 and along 13—13 on FIG. 11 and looking in the direction of the attached arrows. FIGS. 12 and 13 show wall 53 with adjacent tiers 63 and 64 or the initial construction of such tiers 63 and 64.

FIGS. 12 and 13 show posts 55 carrying support arms 75 having an end portion 76 attached to plate 88 which in turn is attached by lag screws 89 to individual side members 73.

FIGS. 14 and 15 are sections taken on FIG. 9 looking respectively along lines 14—14 and 15—15 while looking in the direction of the attached arrows.

FIG. 17 shows a recess 121 produced by removing knock out plates 95 shown on FIGS. 14 and 15.

FIG. 21 shows pipe sleeves 96 restrained in position by small guide rods 115 inserted in flanged nuts 111.

FIG. 22 has a horizontal top preformed special corrugated surface 46, suitable for nesting large sectioned composite floor form 86.

FIGS. 23 and 24 are enlarged details showing elements of my invention also previously shown on FIG. 13.

FIGS. 23 and 24 respectively show a preferred hitching post 97 and an alternate hitching post 100 for reinforcing rods 47, the preferred hitching post 97 utilizing a mini-diameter tube 98. The alternate hitching post 100 utilizing a small tube sleeve 101.

FIG. 25 is a cross-sectional detail showing how lintel 42, shown in FIG. 27 is molded with longitudinal corrugations 120 extending horizontally along the vertical face 54 of wall 53.

FIGS. 26 and 28 show the present day means for making a juncture between floor and walls 93.

FIGS. 27 and 29 show my improved means for making a juncture between floors and walls.

A DETAILED DISCLOSURE OF MY INVENTION AND A FULL DESCRIPTION OF THE DRAWINGS

My invention is for an improved gang form 40 used to construct first second tiers 63 and 64 respectively and additional similar tiers of precast concrete beams 41 by molding fluid concrete in trough-like mold compartments 68.

Figure 6:
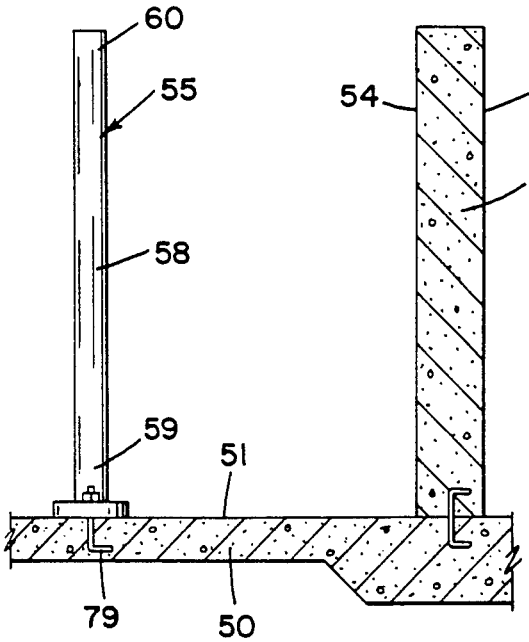
FIGS. 6, 7 and 8 are cross sections taken respectively along lines 6—6, 7—7 and 8—8 as shown on FIG. 1 and looking in the direction of the attached arrows.
Figure 7:
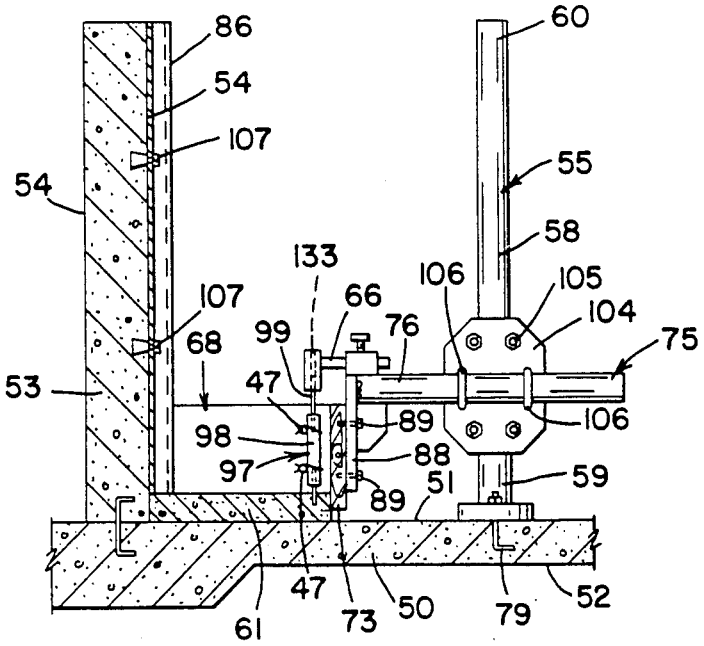
Figure 8:
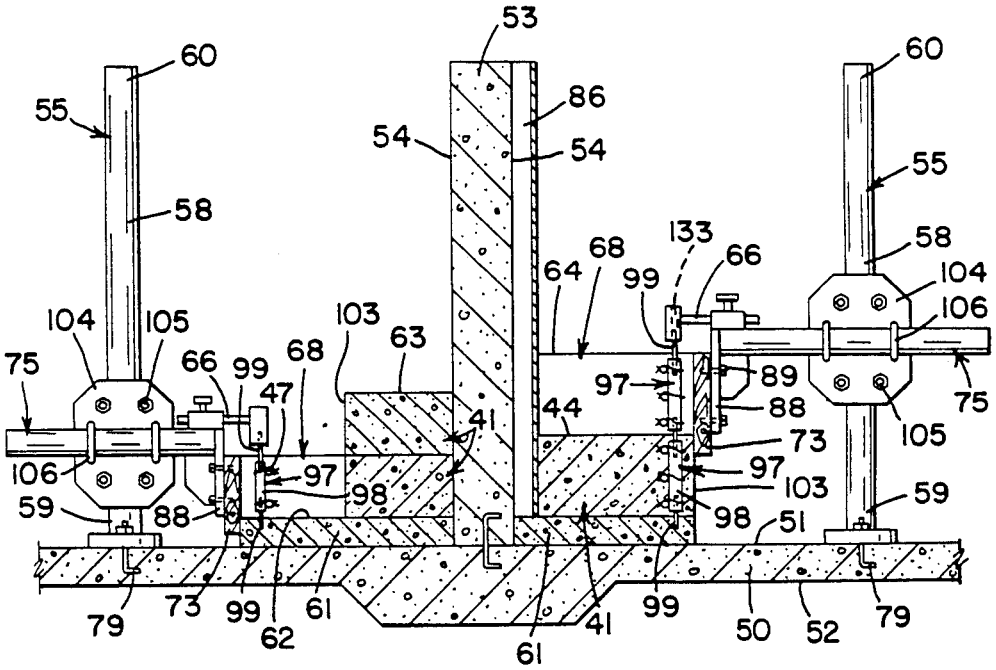
Figure 12:
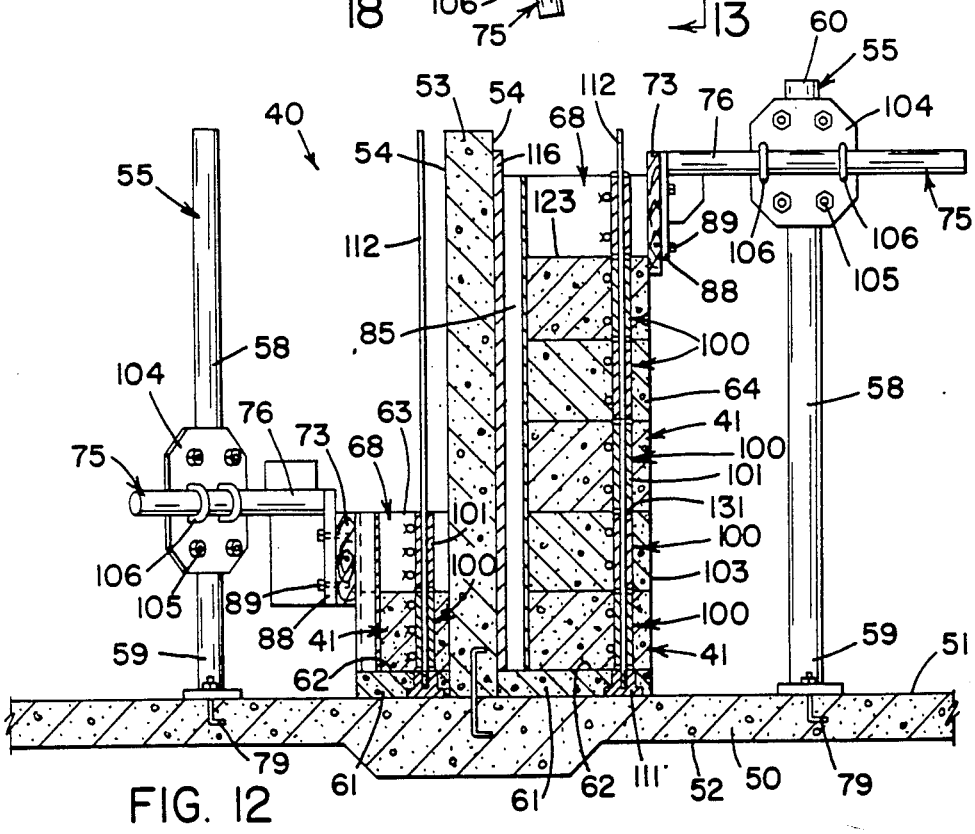

The tiers 63 and 64 of precast concrete beams 41 being constructed on the top surface 62 of starter slabs 61 constructed on the top surface 51 of base slabs 50, are shown on FIGS. 6 through 8. First and second tiers 63 and 64 can be constructed adjacently to the two opposing vertical surfaces 54 of concrete wall 53, while additional tiers of precast beams 41 can be constructed against the vertical face 103 of the previously constructed tiers 63 and 64 as shown in FIGS. 8 and 12.

Figure 1:
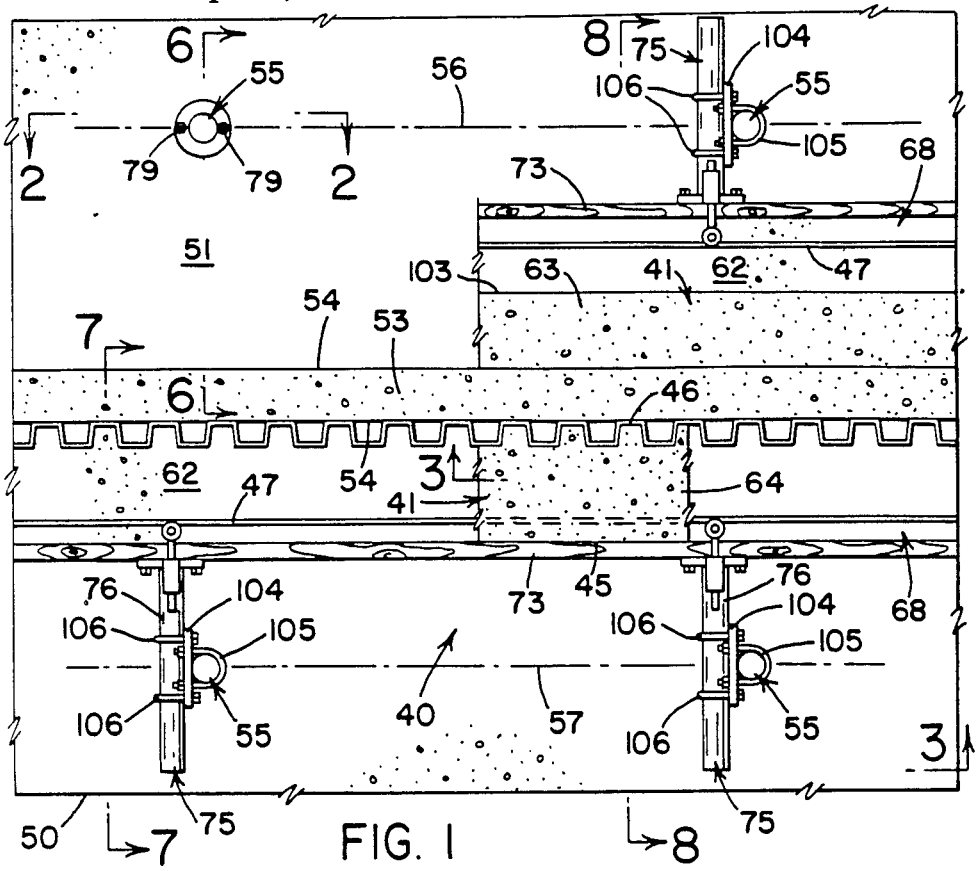
FIG. 1 is a plan view showing the major basic elements of my gang form 40 comprising: wall 53, support posts 55 spaced apart from wall 53, the posts 55 having attached support arms 75 with end portions 76 attached to individual mold side members 73 adjacent to mold compartments 68.

FIG. 1 is a plane view showing the major basic elements of my improved gang form 40 comprising a vertical wall 53 having vertical plain surfaces 54. The gang form 40 further comprises support posts 55 in aligned rows 56 and 57, spaced apart from while parallel to the vertical surfaces 54 of wall 53.

The support posts 55, as shown in FIGS. 2, 6, 7 and 8, have a top end 60 and a bottom end 59 with a body portion 58 between the ends. The bottom end 59 has an attached plate with holes engaging anchors 79 rigidly attaching the posts 55 to the base slab 50. The body portion 58 of support posts 55 has a horizontal support arm 75 attached thereto. FIGS. 1, 6, 7 and 8 show that the support arm 75 is vertically adjustable to be positioned at various elevations above the base slab 50. Also the support arm 75 is horizontally adjustable to be placed at various distances apart from the faces 54 of wall 53.

The above adjustment is achieved by providing an attachment plate 104 with holes provided therein to receive "U" bolts 105 and 106. FIGS. 6, 7, 8, 11 and 13 show the adjustment provisions consisting of "U" bolts 105 and 106 which can be both loosened and retightened as needed.

Figure 2:
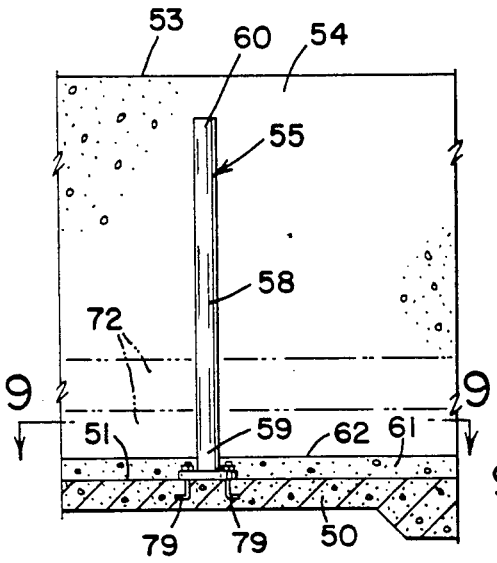
FIGS. 2 and 3 are elevational views taken on FIG. 1 along respective lines 2—2 and 3—3 and looking in the direction of the attached arrows.
Figure 3:
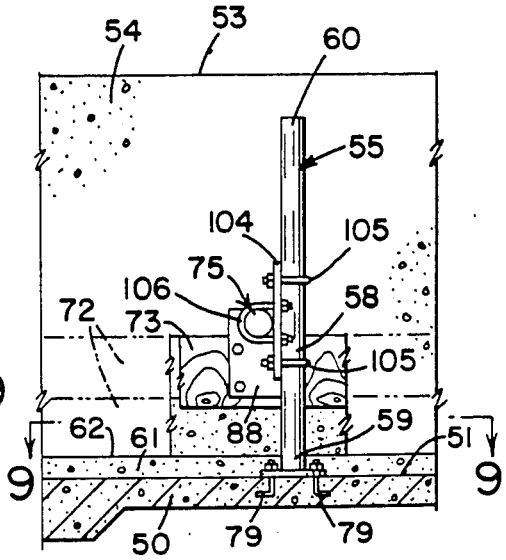

FIGS. 2 and 3 are elevational views taken on FIG. 1 along lines 2—2 and 3—3 and looking in the direction of the attached arrows. The FIGS. 2 and 3 show longitudinal segments 72 of the vertical surface 54 of wall 53. The segments 72 act as a confining mold side surface for mold compartment 68, while the mold compartments 68 confine a pour of fluid concrete. FIGS. 2 and 3 show starter slabs 61 poured on the top surface 51 of base slab 50.

Figure 4:
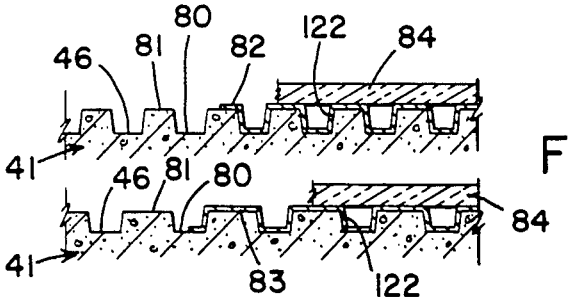
FIGS. 4 and 5 are enlarged cross-sectional details of a top portion of special unyielding surfaces 46 of precast beams 41. The surfaces 46 are imprinted with alternate unyielding concave valleys 80 and unyielding convex reidges 81.
Figure 5:
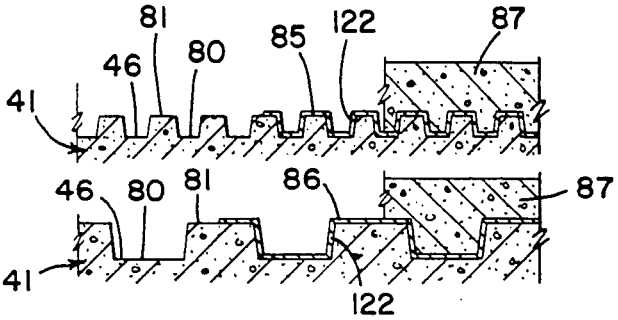

FIGS. 4 and 5 show enlarged details of top portion of the improved corrugated preformed surface 46 of precast concrete beams 41. FIGS. 4 and 5 explain a most important feature of my improved gang form 40. Namely its provision of a built-in juncture means for attachment to precast concrete beams.

FIG. 4 shows the top surface of a precast beam 41 having a preformed improved corrugated surface 46, which preformed surface 46 is imprinted with alternate concave valleys 80 and convex ridges 81 into which can be nested narrow rib metal roof deck 82 and wide rib metal roof deck 83, while demonstrating the operation of a built in juncture means. A tighter than glove tight fit is provided between the top surface of beam 41 and the metal decks 82 and 83. This tighter than glove tight fit is far superior to the attachment of present day metal decks to their support beams. Should an absolute rigid unyielding attachment of the metal decks 82 and 83 to the top surface of beam 41 be necessary and desired, the valleys 80 and ridges 81 should be coated with an adhesive prior to nesting the metal roof decks 82 and 83. The ridges 81 of the deck are generally mopped with hot tar before the insulation 84 is laid thereupon, while the hot tar, upon cooling, attaches the insulation 84 to the metal roof decks 82 and 83. This mopping operation would remain as now used. The roof covering is not separately lifted from the roof by wind during a hurricane, but the entire roof structure of metal deck, insulation and covering together, is stripped off of the building by the violent wind.

FIG. 4 shows narrow rib metal roof deck 82 and wide rib metal roof deck 83 nesting into the valleys 80 and capping the ridges 81 of beam 41. The concave valleys 80 of the metal roof decks 82 and 83, when inserted down into the mating preformed unyielding valleys 80 of the beam 41, produce a wedge-pinching action. The corrugated sheets of metal roof decks 82 and 83 all have sloping side portions 122 required to be slightly sloping because of the roll forming requirements of such sheets. The slight slope of the side portions 122 provides an ideal situation for wedge action, while the convex ridges 81 of the roof decks 82 and 83, capping over the mating unyielding preformed ridges 81 of the beam 41, produces a stretching action within the ridges 81 of the metal roof decks 82 and 83. Therefore it can be said that a tighter than glove tight fit is achieved in the attachment of the metal roof decks to their support beams.

FIG. 5 is an enlarged cross-sectional detail of a top portion of the preformed improved corrugated surface 46 of a precast concrete beam 41 as formed within my improved gang form 40. The top surface 46 is imprinted with alternate concave valleys 80 and convex ridges 81 into which can be nested small sectioned composite floor form 85 and large sectioned composite floor form 86, prior to the composite floor slab 87 being poured. Both the weight of the floor slab 87 and working men treading about on the composite deck while placing and finishing the concrete slab 87 produces a tighter than glove tight fit between the composite floor forms 85 and 86 and the top surface of the beam 41. Should a rigid and absolute unyielding attachment be needed and desired, the valleys 80 and ridges 81 should be coated with an adhesive bonding agent.

The floor slab 87 being provided with moment resistance reinforcing by the composite floor deck forms 85 and 86 act as reinforcing for the slab between its support beams. The composite floor form deck remains permanently in place to act both as a form and thereafter as slab reinforcement. This type of floor construction is now most popular in the building field.

FIG. 5 shows that the concave valleys 80 of the composite floor forms 85 and 86, when inserted down into the mating preformed unyielding valleys 80 of the beam 41, produce a wedge pinching action, while the convex ridges of the composite floor forms 85 and 86 capping over the mating preformed unyielding ridges 81 of the beam 41, producing a stretching action within the ridge 81 of the composite deck. The corrugated sheets of composite floor decks 85 and 86 all have sloping side portions 122 required to be slightly sloping because of roll forming requirements of such sheets. The slight slope of the side portions 122 provide an ideal situation for developing wedge action.

FIG. 6 is a cross-section taken along line 6—6 as shown on FIG. 1 and looking in the direction of the attached arrows. FIG. 6 shows base slab 50 having a top surface 51 carrying a wall 53 and both a start slab 61 and a support post 55. The wall 53 has plane opposing vertical surfaces 54.

FIG. 7 is a cross-section taken along line 7—7 as shown on FIG. 1 and looking in the direction of the attached arrows. FIG. 7 shows base slab 50 having a top surface 51 carrying a wall 53, support post 55 and a starter slab 61, which is a part of the gang form 40. The one vertical surface 54 of wal 53 has an attached facing of vertical sheets of large sectioned composite floor form 86 with its corrugations extending vertically. The vertical sheets 86 can be attached directly to surface 54 by an adhesive bonding agent acting together with random spaced screw anchors 107.

FIG. 7 shows horizontal support arm 75 having an end portion 76 attached to second plate 88 with holes engaging lag screws 89 attaching the individual mold side member 73. The individual mold side member 73 and a segmental portion 72 of the large sectioned composite floor form 86 fashion the mold compartment 68.

FIG. 7 shows a preferred reinforcing rod hitching post 97 further shown in detail on enlarged FIG. 24. FIG. 7 shows small-diameter tube 98 with its tube ends restrained in position by pegs 99. The small-diameter tube 98 has reinforcing rods 47 wired to it.

FIG. 8 is a cross-sectional view taken along line 8—8 as shown on FIG. 1 and looking in the direction of the attached arrows. FIG. 8 shows a tier 63 of precast concrete beams 41 and an adjacent form compartment with the preferred reinforcing rod hitching post 97 just described above in FIG. 7. FIG. 8 shows a tier 64 of precast concrete members 41 and a compartment 68 in which is a preferred reinforcing rod hitching post 97 as described above in FIG. 7. FIG. 8 also shows that additional tiers can be constructed adjacently to both tiers 63 and 64 against vertical tier surfaces 103.

FIG. 9 is a cross-sectional view taken along line 9—9 as shown on FIGS. 2 and 3 and looking in the direction of the attached arrows while showing starter slabs 61 with superimposed tiers 63 and 64 of precast beams 41 adjacent to wall 53. FIG. 9 also shows two transverse end walls 67. FIG. 9 shows pipe sleeves 96 and section 21 showing the sleeves 96 in detail. FIG. 9 also shows wood guide dowels 94 and knock out plate 95 and sections 14 and 15 which show the wood guide dowels 94 and knock out plate 95 in complete detail.

FIG. 10 is a half-plan view of a gang form 40 showing above wall 53 a roof beam 41 suitable for a dome type roof having a curved preformed improved corrugated top surface 46 suitable for nesting wide rib metal roof deck 83 while having a bottom plane surface 45. FIG. 10 also shows below wall 53 a precast beam 41 with a top preformed improved corrugated surface 46 suitable for nesting small sectioned composite floor form 85. Beam 41 has a horizontal bottom plane surface 45.

Figure 11:
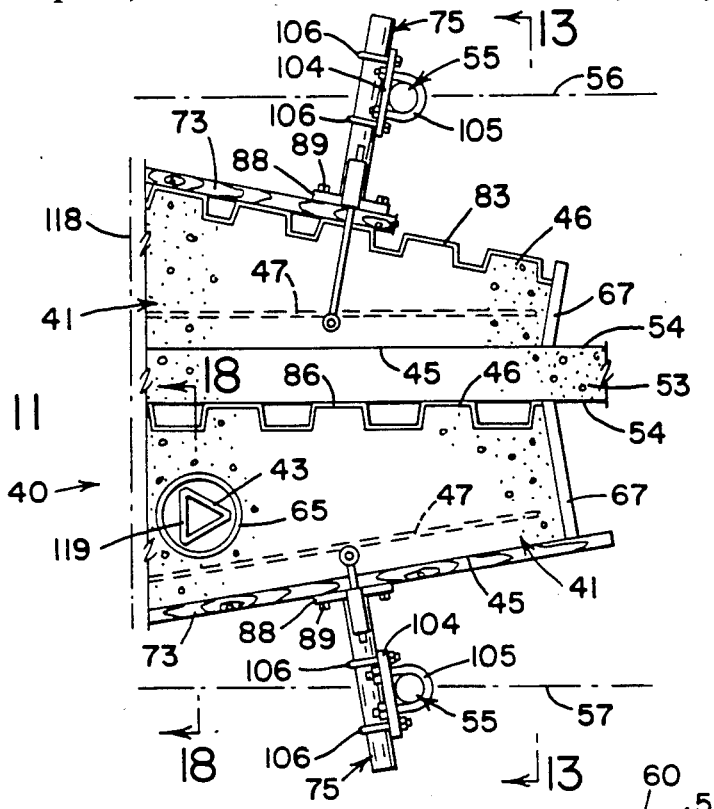
FIG. 11 is a half-plan view showing my gang form 40 above wall 53 fashioning a single sloping precast roof beam 41 with a single sloping top preformed special corrugated surface 46 suitable for nesting wide rib metal deck 83.

FIG. 11 is a half-plan view showing my gang form 40 above wall 53 fashioning a single sloping precast roof beam 41 with a single sloping top preformed improved corrugated surface 46 suitable for nesting wide rib metal roof deck 83, while roof beam 41 has a horizontal plane surface 45. It is easily understood that the half-plan view shown in FIG. 11 could be symmetrical about a center line such as 118 to then produce a double sloping roof beam. See FIG. 22.

FIGS. 12 and 13 are cross-sectional views taken respectively on FIGS. 10 and 11 respectively along lines 12—12 and 13—13 and looking in the direction of the attached arrows. FIGS. 12 and 13 show wall 53 with adjacent tiers 63 and 64 or the initial construction of such tiers 63 and 64. The tiers 63 and 64 each comprises precast concrete beams molded in trough-like mold compartments 68. FIGS. 12 and 13 show posts 55 carrying horizontal support arms 75 having an end portion 76 attached to plate 88, which in turn is attached by lag screws 89 to an individual side member 73. The individual side members, when spaced apart from the vertical surface 54 of wall 53, will make a mold compartment 68. Mold compartment 68 will have a bottom such as the top surface 62 of starter slab 61 or the upper surface 123 of a previously constructed precast beam 41 when tipped on its side while being molded in its first arrangement in a tier. FIGS. 12 and 13 show first alternate reinforcing hitching posts 100, which alternate hitching posts 100 are shown in enlarged detail on FIG. 24. The alternate hitching post 100 comprises small tube sleeve 101 retained in position by slender guide rod 112 having a lower end retained by flanged nut 111 into which the guide rod 112 is screwed in place. When constructing an initial precast concrete beam 41 upon a starter slab 61, guide rod 112 is restrained in position by guide arm extension 113 as is shown on FIG. 13. Whereas in constructing the additional precast beams 41 above the initial precast beam, the guide rod extension 113 need not be used as is shown on FIG. 12 because the embedment of the small tube sleeve within the initial precast beam will provide all restraint needed for slender guide rod 112. FIG. 12 shows that the guide arm extensions 113 have been omitted as not required when constructing precast concrete beams above the initial precast beam in each tier.

FIGS. 14 and 15 are sections taken on FIG. 9 looking respectively along lines 14—14 and 15—15 while looking in the direction of the attached arrows. Easy machinable and drillable dowels 94 are utilized by use of collars 117 attached to dowels 94 to keep knock out plates 95 in a proper predetermined arrangement, generally at the end of a molded concrete beam. Wood or a brittle fragile tube such as glass or a brittle plastic can be used as the dowels. Such dowels would require to be demolished by forcing a rotating twist drill through the dowel portion embedded within each precast concrete beam.

FIG. 14 shows that when the wood dowels 94 are drilled out down to location 124, the top precast concrete beam 41 can be both removed from its supporting tier and its knock out plate 95 is then ready to be knocked out and away.

Figure 17:
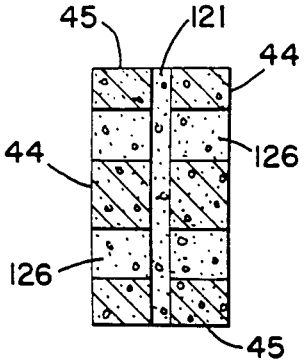
FIGS. 17 and 20 are respectively taken on FIGS. 16 and 19 along lines 17—17 and 20—20 while looking in the direction of the attached arrows.

FIG. 15 shows that when the wood dowels 94 are drilled out down to location 125, the top precast concrete beam 41 can be both removed from its supporting tier, and its knock out plate 95 is then ready to be knocked out and away. When the dowels 94 are drilled out, bolt holes 126 remain available to receive bolts required for attachment of the beam 41 to some support. When the knock out plates 95 are knocked out and away, a flat recess 121 shown on FIG. 17 and FIG. 15 will be provided. Such a recess 121 can accommodate a gusset plate required for making a connection to some support. FIG. 17 also shows the beam side surfaces 44 as the beam would appear when in its in use second arrangement.

Figure 16:
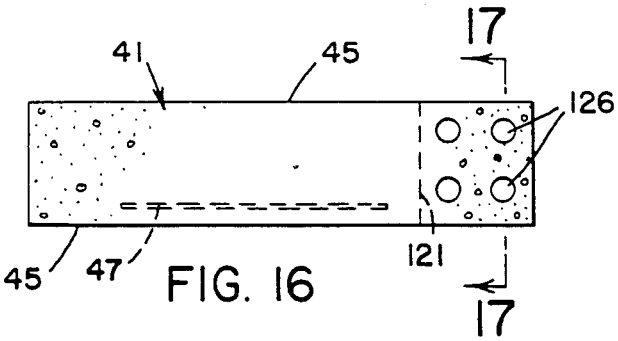
FIGS. 16 and 19 are elevational views of precast beams 41 having a horizontal top plain surface 45 and a horizontal bottom plain surface 45 with mid-span reinforcing rods 47 adjacent to the bottom surface 45.
Figure 19:
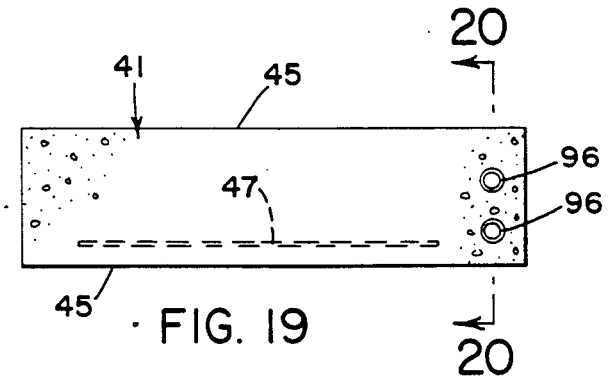

FIGS. 16 and 19 are elevational views of precast concrete beams 41 having a horizontal top plane surface 45 and a horizontal bottom plane surface 45 with midspan reinforcing rods 47 adjacent to the bottom surface 45. FIG. 16 shows a flat recess 121 with bolt holes 126. FIG. 16 shows section 17—17 which is similar to FIG. 15 but represents the uppermost precast beam 41 in FIG. 15 when the wood dowels 94 have been drilled down to location 125 and the knock out plate 95 has been knocked out and away, leaving bolt holes 126 and recess 121.

Figure 18:
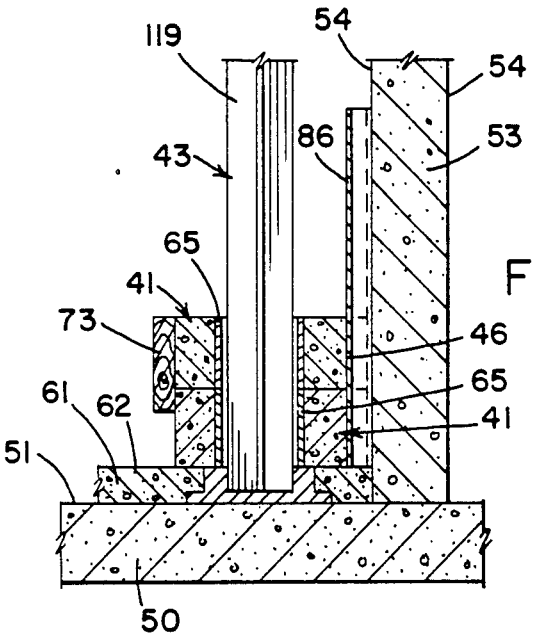
FIG. 18 is a cross-sectional view taken on FIG. 11 along line 18—18 while looking in the direction of the attached arrows.

FIG. 18 is a cross-sectional view taken on FIG. 11 along line 18—18 while looking in the direction of the attached arrows. FIG. 18 shows medium or larger pipe sleeves 65 centered about guide post 43 itself, having an equal lateral triangular cross-sectional configuration 119, shown on FIG. 11 guide post 43 has its lower end inserted in socket 132.

Figure 20:
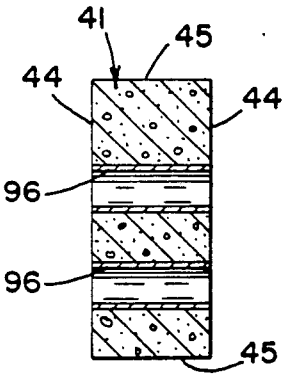

FIG. 20 is a cross-sectional view taken on FIG. 19 along line 20—20 while looking in the direction of the attached arrows. FIG. 20, in addition to showing embedded pipe sleeves 96, shows the side surfaces 44 of beams 41 as the beam appears in its in use second arrangement.

Figure 21:
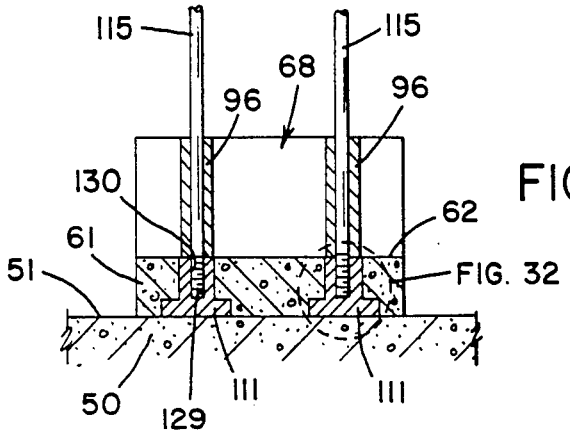
FIG. 21 is taken on FIG. 9 along line 21—21 while looking in the direction of the attached arrows.

FIG. 21 is taken on FIG. 9 along line 21—21 while while looking in the direction of the attached arrows. FIG. 21 shows pipe sleeves 96 restrained in position by small guide rods 115 having lower threaded ends screwed into flanged nuts 111, in mold compartment 68. See detail FIG. 33.

Figure 22:
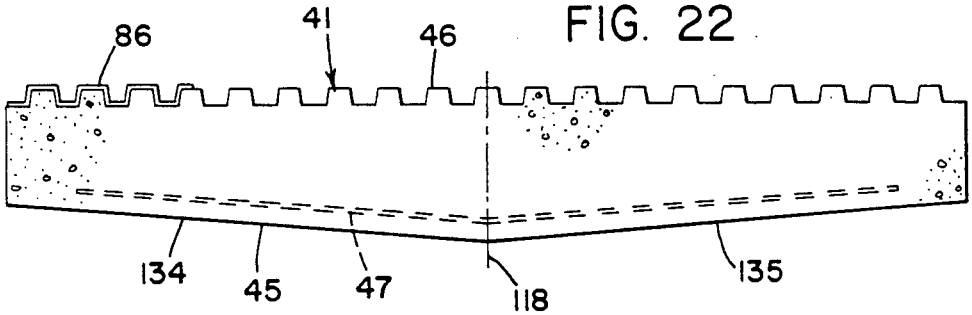
FIG. 22 is an elevational view of precast beams 41.

FIG. 22 is an elevational view of precast beams 41 or slabs 41. FIG. 22 has a horizontal top preformed improved corrugated surface 46, suitable for nesting large sectioned composite floor form 86 while having a plane reverse sloping bottom surface having reverse sloping skew surface portions 134 and 135 adjacent to mid-span reinforcing 47. Precast concrete beams 41 extend between column 92 and wall 93.

Figure 23:
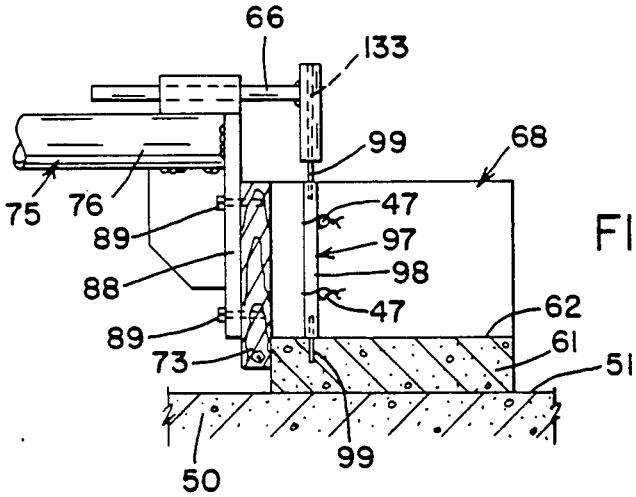

FIGS. 23 and 24 are enlarged details showing elements of my invention also previously shown in FIG. 13.

FIG. 23 shows a preferred hitching post 97 utilizing a small diameter tube 98 for holding reinforcing rods 47 in their required location in mold compartment 68. The small diameter tube 98 has a lower end into which is inserted a peg 99 already embedded in starter slab 61. The small diameter tube 98 has an upper end into which is inserted a peg 99, which peg is also inserted into the vertical bore 133 auxilliary guide arm 66 which is an extension of support arm 75. The reinforcing rods 47 are simply wired in position to the small-diameter tube 98. FIG. 8 shows that both the small-diameter tubes 98 and pegs 99 are cast in place within the precast beams 41. The small-diameter tubes 98, similar to present day chair counterparts, remain permanently embedded within the precast beam. The pegs 99 allow removal of the uppermost beams in a tier and are thereafter pulled out of tubes 98.

FIG. 24 shows an alternate hitching post 100 utilizing a small tube sleeve 101 holding reinforcing rods 47 in their required location within the mold compartment 68. The small tube sleeve 101 inserted over slender guide rod 112 has a lower threaded rod and screwed into flanged nut 111 embedded in starter slab 61. See detail FIG. 32.

In constructing an initial precast concrete beam 41 upon a starter slab 61, the slender guide rod 112 is also restrained by auxilliary guide arm extension 113, which is an extension of support arm 75, and is somewhat similar to auxilliary guide arm 66 previously described. FIG. 12 shows that when constructing the remaining precast concrete beams above the initial beam resting upon the starter slab, the auxilliary guide arm extension 113 is not needed and is therefore discarded. Since open joints occur at the ends of small tube sleeve 101, a rubber "O" ring 131 is generally provided at the open joints to prevent liquid concrete seeping into the small tube sleeve 101 and making it difficult to unscrew the slender guide rod 112 when removing the guide rods from a tier of precast concrete beams 41. The seepage of liquid concrete into the small tube sleeves 101 may be a disadvantage which can be overcome by use of the preferred construction shown on FIG. 23.

FIG. 25 is a cross-sectional detail showing how a lintel or header beam 42, such as the beam 42 shown in FIG. 27, can be constructed. The lintel beam 42 is molded with longitudinal corrugations 120 extending horizontally along the vertical face 54 of wall 53. These corrugations are transverse to all corrugations previously presented in this disclosure. The restricted use of special lintel beams 42 is to provide a rigid attachment for composite floor forms and metal roof decks at walls where the walls parallel the ribs of the corrugated sheets.

Figure 28:
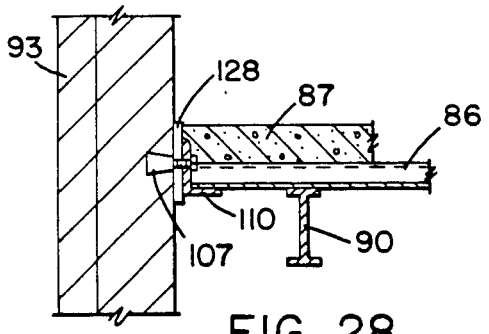

FIGS. 26 and 28 show the present day means for making the floor and roof deck non-functioning juncture with a wall. In reality it is not an attachment but the provision of a shelf 110 upon which the loose edge of the floor or deck can be loosely placed for support only, while being independent of the wall. A premolded strip 128 is generally provided at this juncture because movement between the wall and floor will always occur, producing an ugly gap at the edge of the floor.

Figure 29:
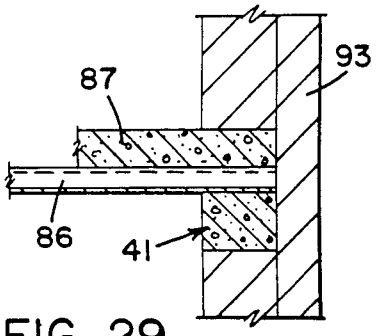

FIGS. 27 and 29 show my improved means for making a functioning juncture between the floor and walls. FIG. 27 shows the large sectioned composite floor form 86, its longitudinal corrugation 120 nesting into the precast concrete lintel 42, while the composite floor slab 87 is constructed upon form 86 and the wall 93 is thereafter continued upward in its construction. This construction makes a rigid juncture or joint between the wall 93 and its supported floor 87.

FIG. 29 shows the large sectioned composite floor form 86 with its transverse corrugations nesting into the usual precast concrete beam 41. While the composite floor slab 87 is constructed upon the form 86, the wall 93 is thereafter continued upward in its construction. This construction makes a rigid juncture or joint between the wall 93 and its supported floor 87.

Figure 30:
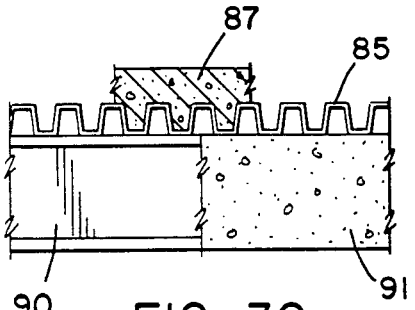
FIGS. 30 and 31 by visual inspection alone, will demonstrate why present practices of attaching composite floor forms and metal roof decks to steel and concrete beams are all a failure. This I have previously pointed out in detail. A firm, rigid attachment of the metal floor form or metal deck would have to be achieved between it and the beam upon which it rests to make a satisfactory attachment between the two. In reality, it can be said that no attachment exists where an attachment is expected to exist. This has been a long-standing fallacy in the building field.
Figure 31:
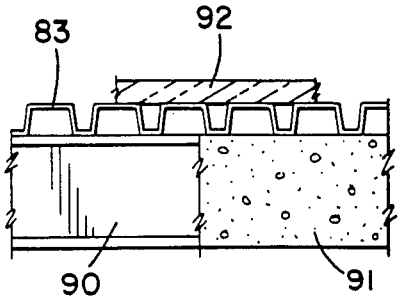

FIGS. 30 and 31, by visual inspection alone, will explain why present practices of attaching composite floor forms and metal roof decks to steel 90 and concrete beams 91 are all a failure. This fact I have previously pointed out in detail. But because of its importance, I will again explain this. A firm rigid attachment of the metal floor form or metal deck would have to be achieved between it and the beam upon which it rests to make a satisfactory attachment between the two. Otherwise resting any object upon a shelf 110 does not attach the object to the shelf. Relying upon the friction due to the weight of the object or floor to make an attachment between the object and shelf or beam can at best be only considered as a weak ineffective attachment not even worthy of consideration in a building construction.

There is no present successful means for field-welding small or large sectioned composite floor forms such as 85 or 86 to steel beams or joists. Of course it is obvious that one cannot field-weld corrugated metal sheets to concrete beams.

It is now a common practice to coat with a bond release agent all interior surfaces of concrete forms and other such objects to which it is required that fluid concrete in contact with same do not bind or adhere to. In order to simplify this disclosure, I have not mentioned the use of a bond release coating. But it should be understood that the interior surfaces of mold compartments, the surfaces of starter slabs and previously constructed beams on which other beams are to be constructed, will be coated with a form release agent. This would include corrugated sheets attached to the walls and individual mold side members. Also members which are later to be removed from within the mold compartments, such as knock out plates, should be coated with a bond release agent.

Figure 32:
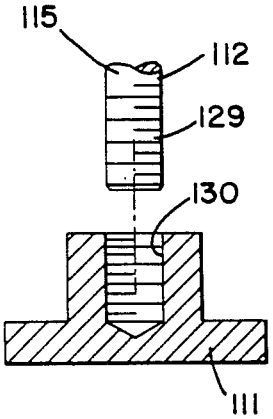
FIG. 32 is an enlarged detail taken on FIG. 21 showing the threaded male end 129 of guide rod 115 and the female thread 130 of flanged nut 111.

FIG. 32 is an enlarged detail taken on FIG. 21 showing the male threaded end 129 of guide rods 115 and 112 the female thread 130 of flanged nut 111 into which nut 111 the guide rods 115 and 112 are to be entered and subsequently removed.

Even a visual inspection of FIG. 27 will show that the composite floor form 86 is transversely keyed to precast concrete lintel 42 by long corrugation 120. In other words, it is restrained from pulling away from wall 93, which is not the case in FIGS. 26 and 28.

I claim:

1. A gang form for molding a plurality of elongated concrete beams, each beam, when in use, having a pair of spaced apart, elongated, generally vertical side surfaces interconnecting a top surface and a bottom surface, said top surface having corrugations extending over the length of the beam, said beam further including embedded reinforcement adjacent to said bottom surface, said beams being molded on their sides, one beam on top of another in superimposed tiers such that the vertical side surfaces are cast in a generally horizontal position, the gang form comprising a concrete base slab having a planar upper surface; a straight vertical concrete form wall rigidly secured centrally on said planar upper surface; a starter slab adjacent to the base slab and extending transversely from at least one side of said form wall; a plurality of upright posts attached to the upper surface of the base slab and spaced from said at least one side of said form wall, said posts being aligned in a plane parallel to said at least one side of said form wall, each post having a central body portion; a plurality of horizontal support arms each having an extended end portion; means for adjustably attaching one of said arms to the central body portion of each of said posts such that the arms may be vertically and horizontally adjusted relative to said posts; an individual mold side member rigidly attached to said end portions of said arms and having a vertical height substantially less than the vertical height of said form wall, thereby enabling said mold side member to be positioned at various elevations above the base slab as well as at various distances from said at least one side of said form wall; a pair of spaced apart end wall mold members extending transversely from said at least one side of said first wall; at least one of said mold side member and said form wall having attached on a molding face thereof a plurality of corrugated sheets; said at least one side of said form wall, said individual mold side member, and said end wall mold members together defining an open top elongated trough mold compartment with a bottom molding face defined either by said starting slab for a first tier of molded beams, or by a previous tier for second and subsequent tiers of molded beams.

2. A gang form according to claim 1 wherein a plurality of corrugated sheets are provided on both molding faces of said at least one side of said form wall and said individual mold side member.

3. A gang form according to claim 2 wherein the corrugation of the sheets on one of the molding faces of said at least one side of said form wall and said individual mold side member extend substantially vertically, while the corrugations of the sheets on the other of said molding faces extends substantially horizontally.

4. A gang form according to claim 2 wherein the corrugations of the sheets extend substantially vertically.

5. A gang form according to claim 2 wherein the corrugations extend substantially horizontally.

6. A gang form according to claim 1 wherein said individual mold side member comprises at least two angularly related mold side segments.

7. A gang form according to claim 1 wherein the molding face of said individual mold side member is curved over the length thereof.

8. A gang form according to claim 1 further comprising means for positioning a separate pipe sleeve in the mold compartment for each tier of molded beams, said means for positioning comprising a flanged nut embedded in said starter slab, said nut having an open central threaded bore; and a removable vertical guide rod having an upper elongated first end, and a lower threaded second end threadedly received in the bore of the embedded nut, whereby a plurality of pipe sleeves may be placed over the rod for sugsequent embedment in successive tiers of beams.

9. A gang form according to claim 8 wherein said means for positioning pipe sleeves further comprising a guide arm attached to the end portion of a horizontal support arm, said guide arm having a vertical bore through which said upper elongated first end of said guide rod extends.

10. A gang form according to claim 1 comprising means for positioning a plurality of small diameter post segments one above another over the starting slab, each of said segments having a bore extending coaxially inwardly from each end thereof, said means for positioning comprising a plurality of pegs, each peg received in the mating bores of a pair of said segments, with one peg partially embedded in said starter slab to receive a lowermost segment and another peg for an uppermost segment extending into a vertical bore of a guide arm attached to the end portion of a support arm.

11. A gang form according to claim 1 for forming a plurality of beams each having two or more transverse bolt holes and a recess slot, said form further comprising a pair of removable elongated wood dowel rods, each dowel rod having a central body portion extending between upper and lower dowel rod ends, the lower dowel ends each having a small axial bore, the starter slab having two or more pegs partially embedded therein with a portion of the pegs extending above the starter slab received in the small bores of the dowel rods; a plurality of collars securely positioned over the dowel rods at a plurality of selected positions corresponding to the tiers of beams to be molded; and a plurality of horizontal removable knock-out plates each having two or more vertical holes, each said plate resting on at least a pair of said collars with the dowel rods extending through the vertical holes, each said plate further abutting the molding face of the individual mold side member.

12. A gang form according to claim 2 wherein the corrugations of the sheets extend obliquely to both horizontal and vertical planes.

* * * * *